US007443278B2

(12) United States Patent
Kawahata et al.

(10) Patent No.: US 7,443,278 B2
(45) Date of Patent: Oct. 28, 2008

(54) COIL DEVICE, COMPOSITE COIL DEVICE, AND TRANSFORMER DEVICE

(75) Inventors: Yoshio Kawahata, Tokyo (JP); Tomoyuki Kanno, Tokyo (JP); Naoki Sasaki, Tokyo (JP)

(73) Assignee: Sumida Corporation, Tokyo (JP)

( * ) Notice: Subject to any disclaimer, the term of this patent is extended or adjusted under 35 U.S.C. 154(b) by 0 days.

(21) Appl. No.: 12/043,220

(22) Filed: Mar. 6, 2008

(65) Prior Publication Data

US 2008/0186121 A1 Aug. 7, 2008

Related U.S. Application Data

(63) Continuation of application No. PCT/JP2006/317226, filed on Aug. 31, 2006.

(30) Foreign Application Priority Data

Sep. 8, 2005 (JP) ..... 2005-260937

(51) Int. Cl.
*H01F 27/28* (2006.01)

(52) U.S. Cl. ..... 336/220; 336/222; 336/189

(58) Field of Classification Search ..... 336/208, 336/198, 192, 222–225, 189, 220
See application file for complete search history.

(56) References Cited

U.S. PATENT DOCUMENTS

| | | | | |
|---|---|---|---|---|
| 3,169,234 | A * | 2/1965 | Renskers | 336/192 |
| 3,710,289 | A * | 1/1973 | Pax et al. | 335/213 |
| 3,987,386 | A * | 10/1976 | Valliere | 336/20 |
| 4,926,111 | A * | 5/1990 | Lungu | 323/355 |
| 5,726,611 | A * | 3/1998 | Takagi et al. | 333/181 |
| 5,770,991 | A * | 6/1998 | Baird | 336/83 |
| 6,278,355 | B1 * | 8/2001 | Hopkinson et al. | 336/225 |
| 6,472,969 | B1 * | 10/2002 | Hanato | 336/192 |
| 6,919,788 | B2 * | 7/2005 | Holdahl et al. | 336/83 |
| 7,317,374 | B2 * | 1/2008 | Flanders et al. | 336/220 |

FOREIGN PATENT DOCUMENTS

| | | | |
|---|---|---|---|
| JP | 06036938 | A * | 2/1994 |
| JP | 08-055738 | | 2/1996 |
| JP | 2003-173913 | | 6/2003 |
| JP | 2004-040025 | | 2/2004 |
| JP | 2005-158927 | | 6/2005 |

OTHER PUBLICATIONS

International Search Report for PCT/JP2006/317226 issued by the Japanese Patent Office Dec. 2006.

* cited by examiner

*Primary Examiner*—Anh T Mai
(74) *Attorney, Agent, or Firm*—Coats & Bennett PLLC

(57) ABSTRACT

A transformer-type compact and thin coil device having a high coupling degree between a primary coil and a secondary coil, and a transformer device in which a plurality of sets of the transformer-type coil devices are incorporated. A coil device includes a first winding portion in which a primary and secondary coil wires are wound in bifilar form so as to arrange them alternately in a plane, a second winding portion in which a secondary coil wire is wound to arrange it in a plane parallel to the plane of the first winding portion, and a secondary coil connecting portion which connects an inner diameter portions of the secondary coil wires of the first and second winding portions. A transformer device is formed by incorporating a plurality of sets of the transformer-type coil devices each formed in above manner.

9 Claims, 10 Drawing Sheets

COIL DEVICE, COMPOSITE COIL DEVICE, AND TRANSFORMER DEVICE

This application is a continuation of PCT/JP2006/317226, filed Aug. 31, 2006, and claims the benefit of Japanese Patent Application No. 2005-260937, filed Sep. 8, 2005, both of which are hereby incorporated by reference herein in their entirety.

TECHNICAL FIELD

The present invention relates to a coil device, composite coil device, and transformer device suitable to constitute, for example, a low-profile transformer employed in a DC-DC converter or a transformer employed in an inverter and, more particularly, to a coil device, composite coil device, and transformer device having a high degree of coupling between the primary coil and secondary coil.

BACKGROUND ARTS

In recent years, demands for a compact transformer called a low-profile transformer employed in a DC-DC converter or the like increase. Particularly, when a transformer is to be employed in a DC-DC converter used in a compact DC power supply or the like, the low-profile transformer which is compact and low in height is sought for. As is known well, a fluorescent light is usually employed as a backlight in a liquid crystal display device or the like. An inverter circuit that drives a discharge lamp such as the fluorescent light also requires a compact transformer.

Conventionally, in the manufacture of a transformer-type coil device to be incorporated in the compact transformer, a primary winding portion and secondary winding portion which form the coil device are first formed independently of each other, and then the obtained primary winding portion and secondary winding portion are overlaid to constitute the transformer-type coil device. A pair of such transformer-type coil devices are prepared and incorporated with a magnetic core, thus manufacturing a compact transformer. This is how a transformer-type coil device is normally manufactured.

In a compact, low-profile transformer employed in a DC-DC converter, an inverter used for driving a discharge lamp, or the like, one set to a plurality of sets of coil devices each comprising a primary coil and secondary coil are incorporated between an upper core portion and lower core portion to constitute the low-profile transformer.

SUMMARY OF THE INVENTION

Problems that the Invention is to Solve

Particularly, as the product to which the transformer is to be applied becomes compact, demands for a compact transformer arise. When a completed primary winding portion (primary coil) and secondary winding portion (secondary coil) are merely overlaid to form a transformer-type coil device, even if only one set of coil device is employed, the thickness of the coil device increases and poses a problem. When two sets of transformer-type coil devices are incorporated as the transformer device, the thickness further increases, making it difficult to make a compact transformer.

Even if not considering the height, when the primary winding portion and secondary winding portion are combined to form a transformer-type coil device, it is difficult to increase the coupling degree between the primary winding portion and secondary winding portion. This leads to a demand for a highly efficient transformer-type coil device in which a primary coil and secondary coil are arranged in tight contact with each other leaving no gap between them and a magnetic flux generated by the primary coil flows through the entire portion of the secondary coil without generating any waste.

Means for Solving the Problems

According to the first embodiment of the present invention, there is provided a coil device comprising a first winding portion in which a primary coil wire and a secondary coil wire are wound in bifilar form, a second winding portion in which at least the secondary coil wire is wound so as to be arranged in a plane in parallel to a plane of the first winding portion, and a secondary coil connecting portion which connects an inner diameter portion of the secondary coil wire in the first winding portion to an inner diameter portion of the secondary coil wire in the second winding portion.

According to the second embodiment of the present invention, there is provided a composite coil device comprising a first coil device including a primary coil and a secondary coil, and a second coil device including a primary coil and a secondary coil, the first coil device and the second coil device being overlaid in a plane. Then, at least the first coil device comprises a first winding portion in which a primary coil wire and a secondary coil wire are wound so as to be alternately arranged in a plane, a second winding portion in which the secondary coil wire is wound so as to be arranged in a plane in parallel to the plane of the first winding portion, and a secondary coil connecting portion which connects an inner diameter portion of the secondary coil wire in the first winding portion to an inner diameter portion of the secondary coil wire in the second winding portion.

According to the third embodiment of the present invention, there is provided a transformer comprising an upper core portion, a lower core portion, a first coil device including a primary coil and a secondary coil, and a second coil device including a first coil and a second coil, the first coil device and the second coil device being overlaid in a plane and arranged between the upper core portion and the lower core portion. Then, at least the first coil device comprises a first winding portion in which the primary coil wire and the secondary coil wire are wound so as to be alternately arranged in a plane, a second winding portion in which the secondary coil wire is wound so as to be arranged in a plane in parallel to the plane of the first winding portion, and a secondary coil connecting portion which connects an inner diameter portion of the secondary coil wire in the first winding portion to an inner diameter portion of the secondary coil wire in the second winding portion.

EFFECTS OF THE INVENTION

According to the present invention, a coil device having a high coupling degree between a primary coil and secondary coil can be provided. The secondary coil having a large number of turns is divided, each of the divided secondary coils is wound, and the two divided secondary coils are connected to each other on their inner diameter portion. Thus, it is possible to prevent wires to be connected from being sandwiched between the overlaying surfaces of the winding portions, and simultaneously arrange the two divided secondary coils close to the primary coil. Hence, a coil device can be provided which has a high coupling degree between the primary coil and secondary coil and which can be formed thin.

When forming a composite coil device by overlaying two present coil devices, a composite coil device can be provided which has a high coupling degree between the primary coil and secondary coil and which has a small thickness.

If a transformer is formed by employing the composite coil device formed according to an embodiment of the present invention, a compact, highly efficient and low-profile transformer can be provided.

Other features and advantages of the present invention will be apparent from the following description taken in conjunction with the accompanying drawings, in which like reference characters designate the same or similar parts throughout the figures thereof.

BRIEF DESCRIPTION OF DRAWINGS

The accompanying drawings, which are incorporated in and constitute a part of the specification, illustrate embodiments of the present invention and, together with the description, serve to explain the principles of the invention.

EXPLANATION OF REFERENCE NUMERALS

Figure 1:
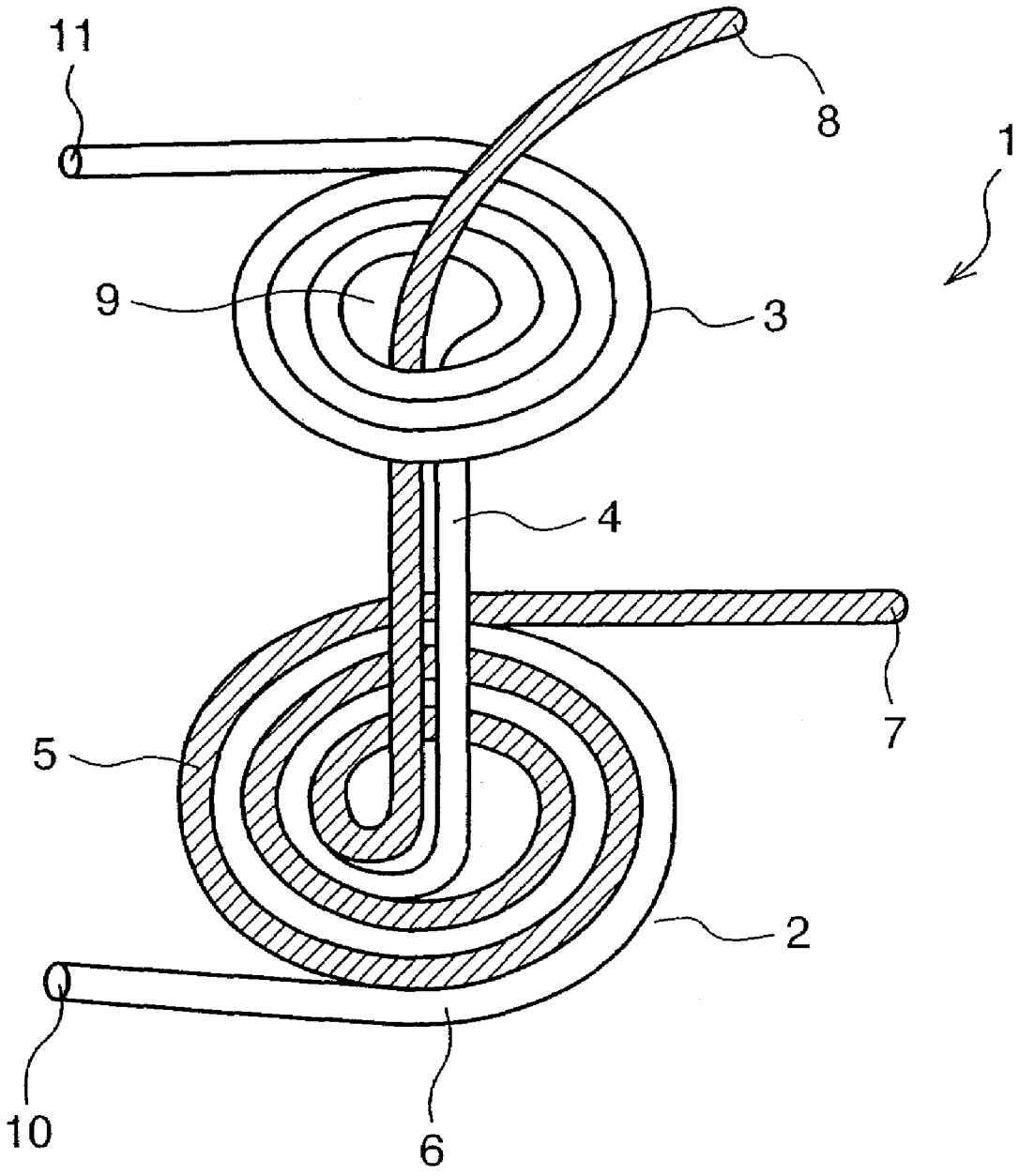
FIG. 1 is a developed perspective view of a coil device according to the first embodiment of the present invention.

1 . . . coil device
2 . . . first winding portion
3 . . . second winding portion
4 . . . secondary coil connecting portion
5 . . . primary coil wire
6 . . . secondary coil wire
7 . . . lead wire of primary coil in first winding portion
8 . . . lead wire of primary coil in central portion
10 . . . lead wire of secondary coil in first winding portion
11 . . . lead wire of secondary coil in second winding portion
20 . . . composite coil device
50 . . . transformer device

DESCRIPTION OF THE PREFERRED EMBODIMENTS

First Embodiment

FIG. 1 shows a coil device according to the first embodiment of the present invention, for example, a double-layer coil device 1 having a transformer structure comprising a primary coil and secondary coil. The coil device 1 basically comprises a first winding portion 2, second winding portion 3, and secondary coil connecting portion 4. In this case, the first winding portion 2 has a structure in which a primary coil wire 5 and secondary coil wire 6 are wound in a plane so as to be arranged alternately. In the second winding portion 3, only the secondary coil wire 6 is wound in a plane.

The secondary coil connecting portion 4 couples the inner diameter portion of the secondary coil wire 6 in the first winding portion 2 to the inner diameter portion of the secondary coil wire 6 in the second winding portion 3. In FIG. 1, the primary coil wire 5 is hatched and the secondary coil wire 6 is illustrated in white so that they can be easily discriminated from each other. As the primary coil wire 5 and secondary coil wire 6, electric wires having round sections and coated by insulating coatings, for example, enameled wires, are employed. The present invention can be performed even if the primary coil wire 5 and secondary coil wire 6 do not have round sections or insulated wires other than enameled wires are used. From the first winding portion 2 of the coil device 1, a lead wire 7 of the primary coil in the first winding portion extends, and a lead wire 8 of the primary coil in the central portion extends through a central hole 9 of the second winding portion 3. A lead wire 10 of the secondary coil in the first winding portion and a lead wire 11 of the secondary coil in the second winding portion also extend, respectively, from the first winding portion 2 and second winding portion 3 of the coil device 1, respectively.

The plane of the first winding portion 2 is parallel to the plane formed by winding in the second winding portion 3. In FIG. 1, a large gap is illustrated between the first winding portion 2 and second winding portion 3 for the descriptive convenience. Actually, the first winding portion 2 and second winding portion 3 are overlaid in tight contact with each other, as shown in FIG. 2, and the gap does not exist.

Figure 2:
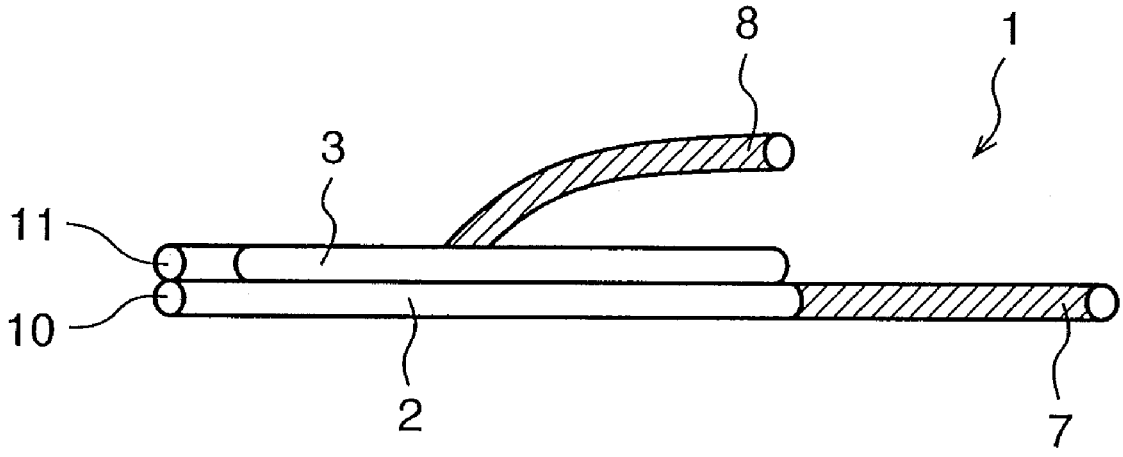
FIG. 2 is a side view of the coil device according to the first embodiment.

More specifically, FIG. 2 is a side view of an actual assembled state of the two-layer coil device 1 of the present invention according to the embodiment shown in FIG. 1. Referring to FIG. 2, the second winding portion 3 is arranged to be overlaid on the plane formed by the first winding portion 2 with no gap between them so as to be in tight contact with the first winding portion 2. The lead wire 8 of the primary coil in the central portion is led through the central hole 9 of the second winding portion 3 without losing the tight contact with the first winding portion 2.

In the embodiment shown in FIGS. 1 and 2, the lead wire 8 of the primary coil in the central portion is led through the central hole 9 of the second winding portion 3. Alternatively, if necessary, the lead wire 8 of the primary coil in the central portion can be led from the lower side in FIGS. 1 and 2 without losing the tight contact between the first winding portion 2 and second winding portion 3.

In the coil device 1 shown in FIGS. 1 and 2, the number of turns of the primary coil is determined by the number of turns of the primary coil wire 5 in the first winding portion 2. The number of turns of the secondary coil is determined by the sum of the number of turns of the secondary coil wire 6 in the first winding portion 2 and the number of turns of the secondary coil wire 6 in the second winding portion 3. In the example shown in FIGS. 1 and 2, the coil device 1 has a winding ratio of 1:2.

Figure 3:
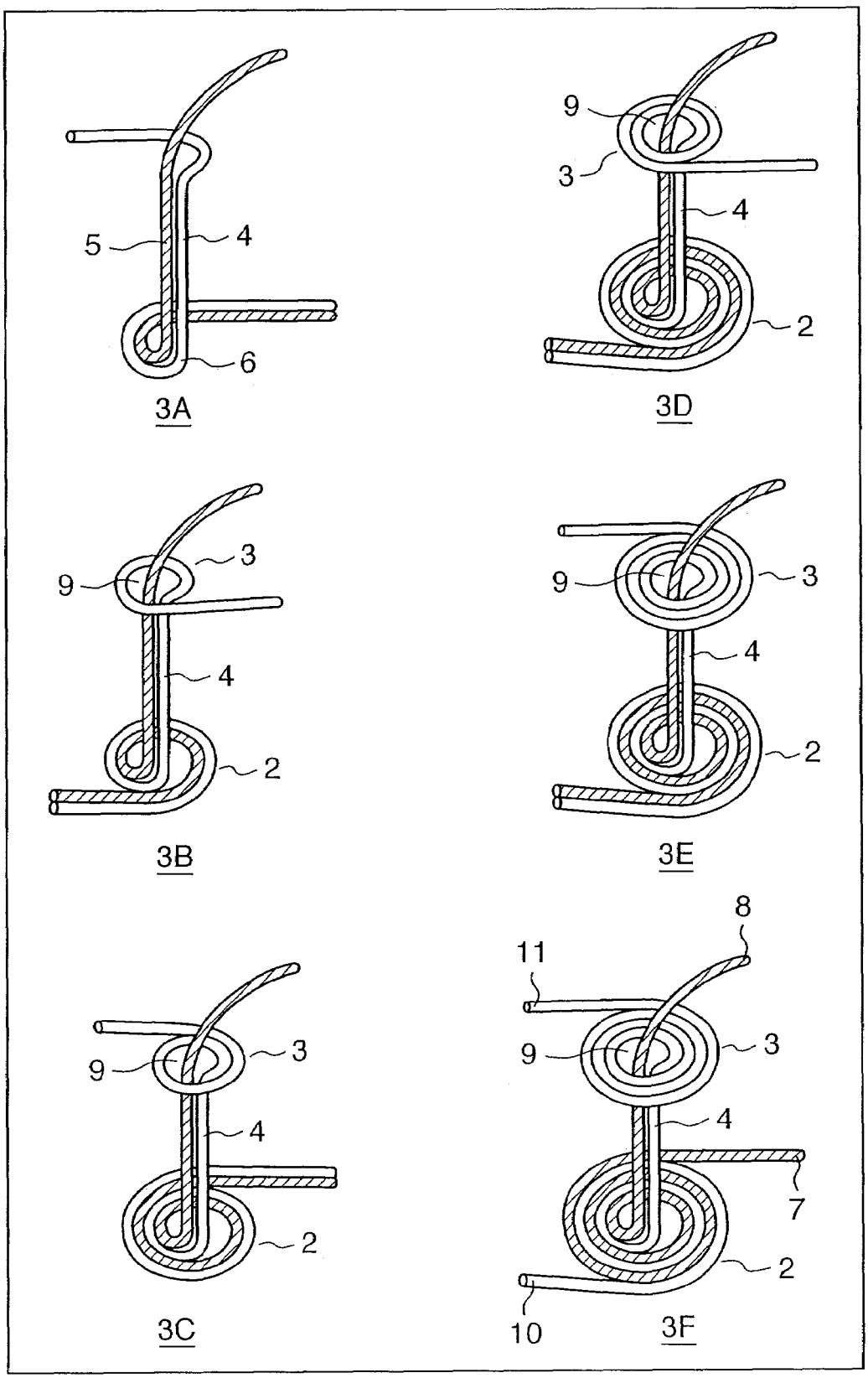
FIG. 3 includes developed perspective views in the respective processes in the manufacture of the coil device according to the first embodiment.

The windings of the coil device 1 shown in FIGS. 1 and 2 are formed in the following processes. More specifically, 3A to 3F in FIG. 3 show the processes of forming the windings. To facilitate understanding in the same manner as in FIGS. 1 and 2, the same reference numerals as those employed in FIGS. 1 and 2 are employed in FIG. 3. For the sake of convenience, the primary coil wire 5 is hatched, and the secondary coil wire 6 is illustrated in white.

First, assume that α winding (a method of winding from the inner diameter portion toward the outer diameter portion) is performed using a winding tool (not shown). The lead wire in the primary coil central portion of the primary coil wire 5 is set free from the winding tool in advance so that only the secondary coil wire 6 is α-wound in the second winding portion 3 and the primary coil wire 5 and secondary coil wire 6 are wound in bifilar form (a method of bundling two wires and winding the bundled wires from the inner diameter portion toward the outer diameter portion).

In this state, α winding is performed with the winding tool. When winding starts at 3A in FIG. 3, only the first winding portion 2 at the lower side is wound in bifilar form (the method of bundling two wires and winding the bundled wires), as shown by 3B in FIG. 3. Hence, the second winding portion 3 at the upper side is α-wound normally together with the first winding portion 2 at the lower side. 3B in FIG. 3 shows a state in which the primary coil wire 5 is wound by 1.5T (1.5 turns) and the secondary coil wire 6 is wound by 2.5T (2.5 turns) in the sum of windings in the first winding portion 2 and second winding portion 3.

When winding further proceeds, as shown by 3C in FIG. 3, the primary coil wire 5 is wound by 2T (2 turns), and the secondary coil wire 6 is wound by 3.5T (3.5 turns) in the sum of windings in the first winding portion 2 and second winding portion 3.

When winding further proceeds, as shown by 3D in FIG. 3, the primary coil wire 5 is wound by 2.5T, and the secondary coil wire 6 is wound by 4.5T in the sum of windings in the first winding portion 2 and second winding portion 3. In this state, the primary coil wire 5 and secondary coil wire 6 in the first winding portion 2 are removed from the winding tool, and only the secondary coil wire 6 in the second winding portion 3 is continuously α-wound. 3E in FIG. 3 shows a state in which the secondary coil wire 6 in the second winding portion 3 is further continuously α-wound by 1.5T. Hence, the primary coil wire 5 is wound by 2.5T, and the secondary coil wire 6 is wound by 6T in the sum of windings in the first winding portion 2 and second winding portion 3.

In this state, as shown by 3F in FIG. 3, the end of the primary coil wire 5 in the first winding portion 2 is further wound by 0.5T to form the lead wire 7 of the primary coil in the first winding portion. The lead wire 8 of the primary coil in the central portion is led in the same direction as that of the lead wire 7 of the primary coil in the first winding portion, and a coil device is formed so that the primary coil wire 5 is wound by 3T. When winding is performed in the above manner, the double-layer coil device 1 having a winding ratio of 1:2 as described with reference to FIGS. 1 and 2 can be obtained.

As described above, the lead wire 8 of the primary coil in the central portion can alternatively be led from the lower side in FIG. 1. In the first embodiment, the winding ratio of the first winding portion 2 can be changed. The primary coil can be also wound in the second winding portion 3. In this case, in the second winding portion 3, the primary coil wire and secondary coil wire are wound as well to be alternately arranged in a plane. It is not necessary that the size of the primary coil wire 5 and that of the secondary coil wire 6 are the same.

Regarding the winding ratio of the completed coil device 1, for example, the winding ratio of the primary coil to the secondary coil is 1:2. However, a coil device having a different winding ratio can also be formed. If necessary, the secondary coil wire 6 may be thinner to increase the winding ratio. Assume that a coil device having a large winding ratio, for example, a winding ratio of the primary coil to the secondary coil being 1:5, is required. In this case, if the coil device 1 having a structure as shown in FIGS. 1 and 2 is to be employed, the diameter of the second winding portion 3 becomes excessively large, providing a coil device not preferable in terms of the coupling degree as well as the size.

Thus, when the winding ratio of the primary coil to the secondary coil increases and the diameter of the second winding portion 3 is larger than that of the first winding portion 2, the second winding portion 3 may be divided into two. More specifically, the two divided secondary winding portions are arranged on the upper and lower surfaces of the first winding portion 2, so as to be overlaid in tight contact with each other with no gap between them, thus forming a three-layer structure.

Figure 4:
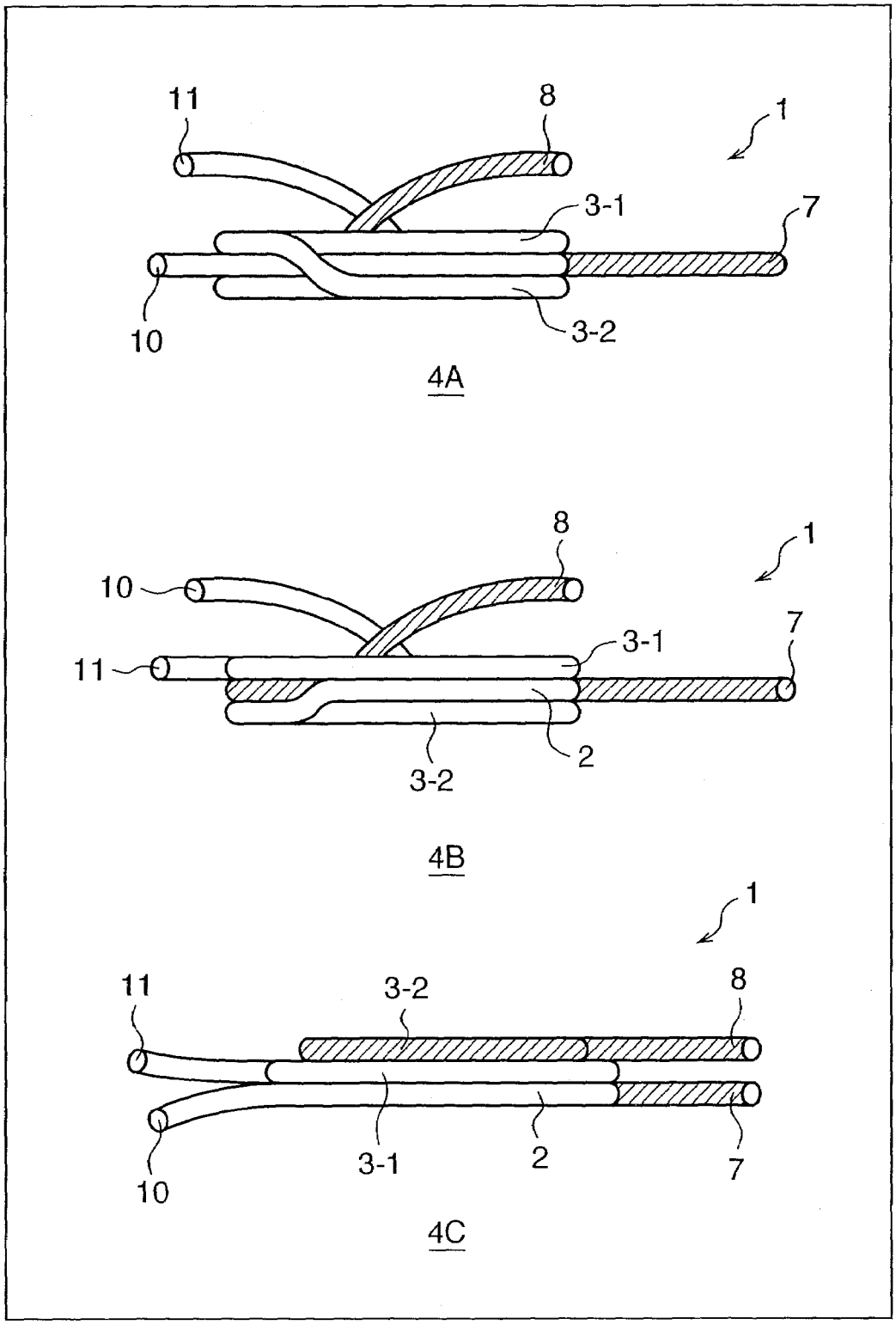
FIG. 4 includes side views of modifications of the coil device according to the first embodiment.

As shown by 4A in FIG. 4, second winding portions 3-1 and 3-2 are arranged on the upper and lower surfaces of the first winding portion 2, so as to be overlaid in tight contact with each other. In this case, the secondary coil wire 6 is guided from the outer diameter portion of the second winding portion 3-1 on the upper side in 4A in FIG. 4 across the outer surface of the first winding portion 2 to the lower side of the first winding portion 2. On the lower side, the secondary coil wire 6 is wound from the outer diameter portion toward the inner diameter portion along the lower surface of the first winding portion 2. Then, the lead wire 11 of the secondary coil in the second winding portion is led through the central holes 9 of the second winding portion 3-2, first winding portion 2, and second winding portion 3-1.

Alternatively, as shown in 4B in FIG. 4, the lead wire 10 of the secondary coil in the first winding portion is directed downward from the outer diameter portion of the first winding portion 2, wound as a second winding portion 3-2 from the outer diameter portion toward the inner diameter portion on the lower side of the first winding portion 2, and led to the upper side through the central hole 9. Hence, the coil device having a three-layer structure of this application as shown in 4A or 4B in FIG. 4 can be employed as a coil device having a large winding ratio.

To obtain a more compact coil device without considering the winding ratio, if the primary coil wire 5 is wound above a second winding portion 3-1 to form a three-layer coil device, as shown in 4C in FIG. 4, a transformer-structure coil device having a high coupling degree can be provided.

Figure 9:
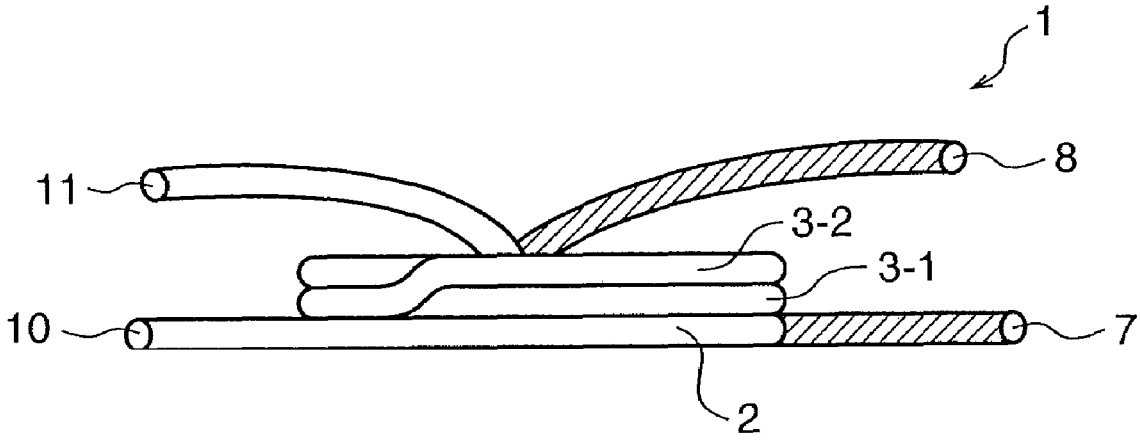
FIG. 9 is a view of a reference for the first embodiment.

In contrast, even in a three-layer coil device, a second winding portion 3-2 can be wound above a second winding portion 3-1, as shown in a reference view of FIG. 9. In the case of FIG. 9, however, a problem occurs in the coupling degree between the primary coil and secondary coil, that is not preferable. In this respect, the three-layer coil device of the embodiment of this application shown by 4A, 4B or 4C in FIG. 4 can provide a coil device having a very high coupling degree.

The coil device according to the first embodiment is not limited to be utilized in a low-profile transformer device but can be utilized in transformer devices for various applications.

Second Embodiment

Figure 5:
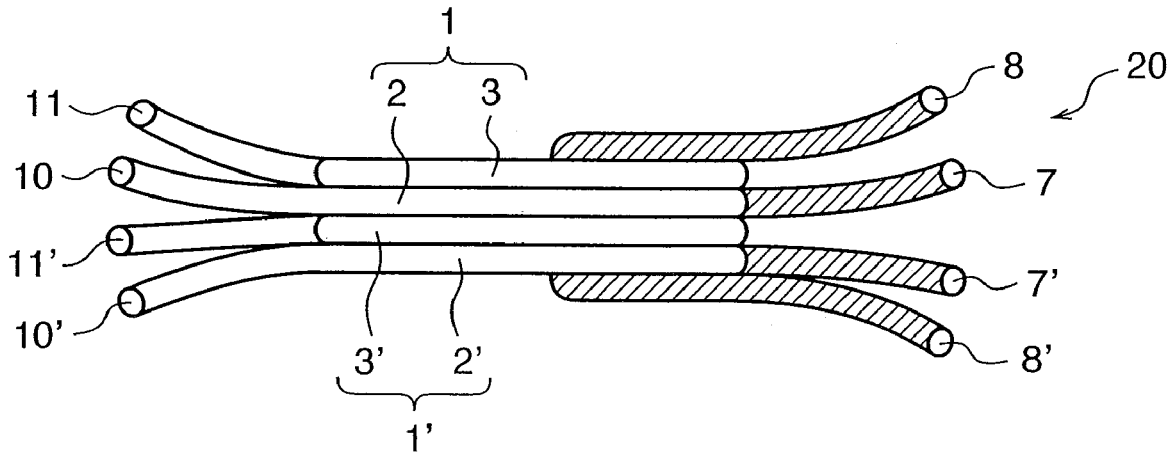
FIG. 5 is a side view of a composite coil device according to the second embodiment of the present invention.

FIG. 5 shows a composite coil device 20 formed by providing two sets of coil devices 1 each shown in FIGS. 1 and 2. More specifically, in FIG. 5, the composite coil device 20 basically has the first coil device 1 having a first winding portion 2 and second winding portion 3, and a second coil device 1' having a first winding portion 2' and second winding portion 3'.

In the first coil device 1, a lead wire 7 of the primary coil in the first winding portion and a lead wire 10 of the secondary coil in the first winding portion are led from outside the first winding portion 2. A lead wire 8 of the primary coil in the central portion is led from inside of the first winding portion 2 through a central hole 9 of the second winding portion 3. Furthermore, a lead wire 11 of the secondary coil in the second winding portion is led from outside of the second winding portion 3.

In the second coil device 1', a lead wire 7' of the primary coil in the first winding portion and a lead wire 10' of the secondary coil in the first winding portion are led from outside of the first winding portion 2'. A lead wire 8' of the primary coil in the central portion is directly led from inside of the first winding portion 2', and a lead wire 11' of the secondary coil in the second winding portion is led from outside of the second winding portion 3'. Hence, the composite coil device 20, in which the four winding portions 2, 3, 2' and 3' of the first and second coil devices 1 and 1' are formed in tight contact with each other, can be obtained.

In the second embodiment shown in FIG. 5, a four-layer composite coil device is formed by overlaying the two sets of coil devices. A multi-layered composite coil device can be formed by overlaying two or more sets of coil devices.

When forming a composite coil device by overlaying two or more sets of coil devices in this manner, all of the overlaid coil devices need not have the structure of the first embodiment. For example, assume that a composite coil device needs to be formed by overlaying a coil device having a winding ratio of 1:1 and a coil device having a winding ratio of 1:2. In this case, even if the coil device shown in the first embodiment of this application is used as the coil device having the winding ratio of 1:2 and a coil device formed only in bifilar form is used as the coil device having the winding ratio of 1:1, a composite coil device with a coil arrangement having a high coupling degree can be obtained.

It is apparent that the three-layer coil device shown in FIG. 4 of the first embodiment can form a composite coil device. When using the three-layer coil device, a lead wire 8 of the primary coil in the central portion and a lead wire 11 of the secondary coil in the second winding portion must be led from the same side. More specifically, if the lead wire 8 of the primary coil in the central portion and the lead wire 11 of the secondary coil in the second winding portion are led from different sides, either lead wires is sandwiched between the overlaid first coil device and second coil device. Then, the height of the resultant structure increases, and a space is formed between the first coil device and second coil device, that is not preferable.

The composite coil device according to the second embodiment of the present invention is not limited to be utilized in a low-profile transformer device but can be utilized in transformer devices for various applications.

Third Embodiment

Figure 6:
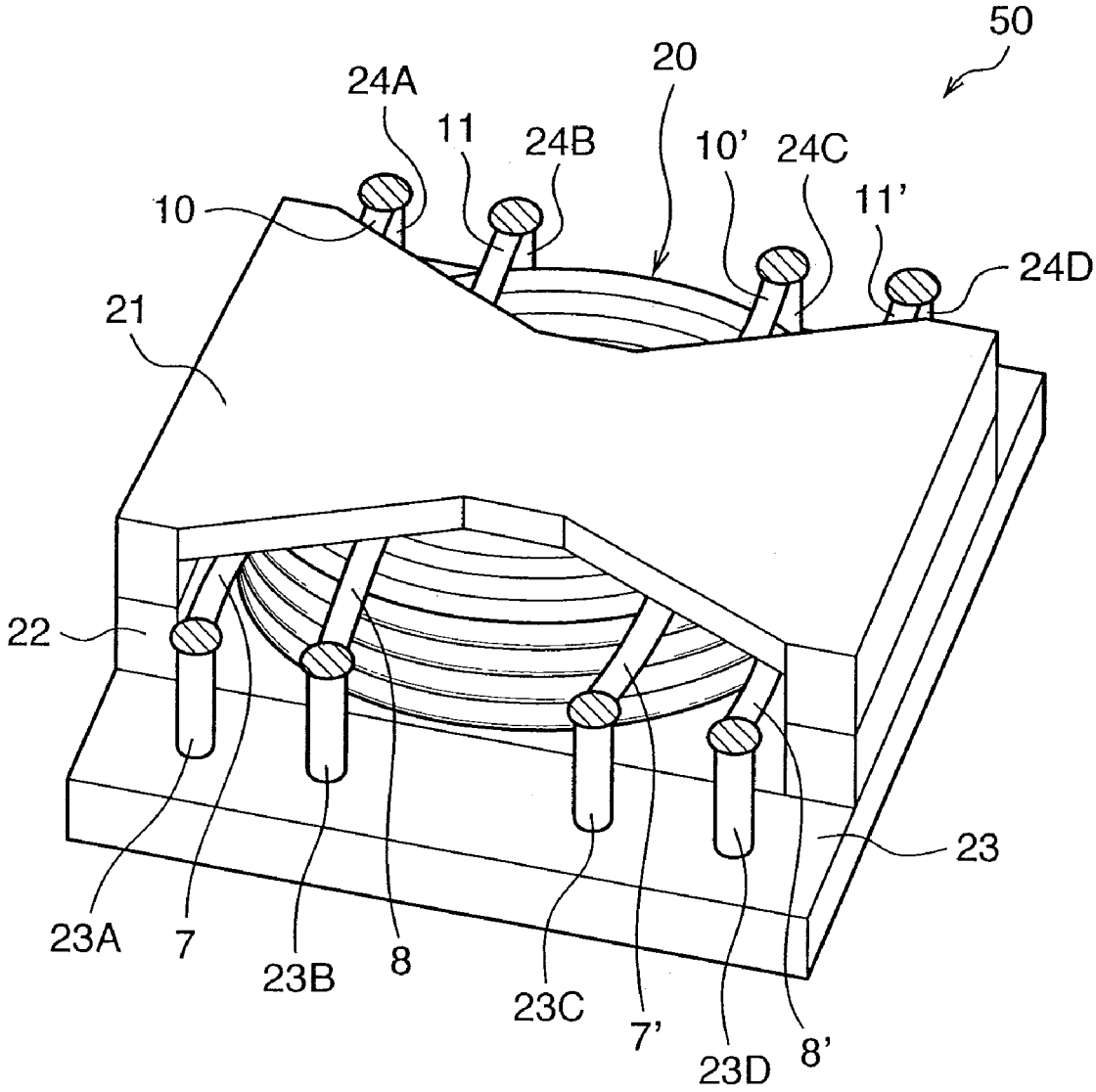
FIG. 6 is a perspective view of a low-profile transformer device according to the third embodiment of the present invention.
Figure 7:
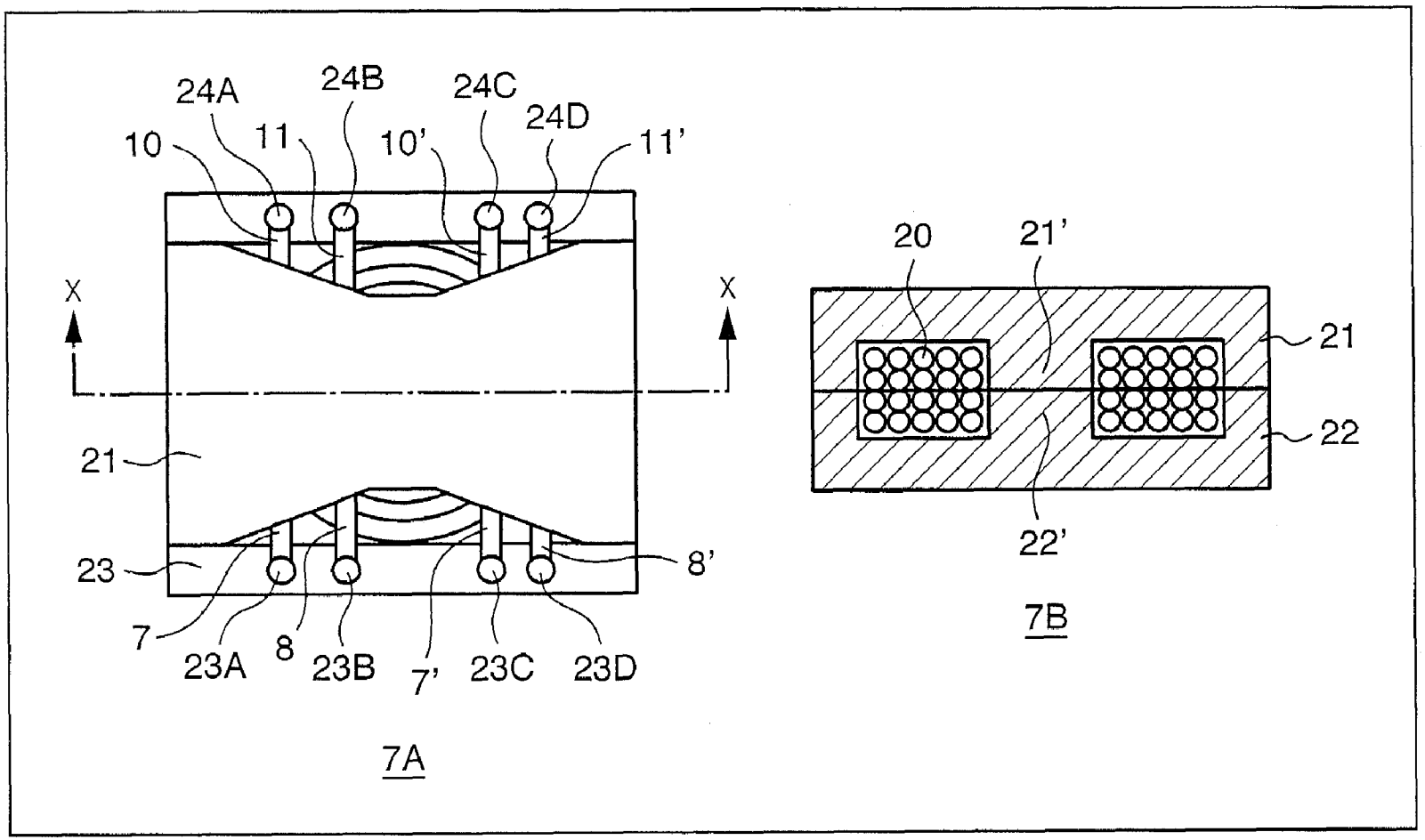
FIG. 7 includes a plan view of the transformer device according to the third embodiment, and a sectional view taken along the line X-X.
Figure 8:
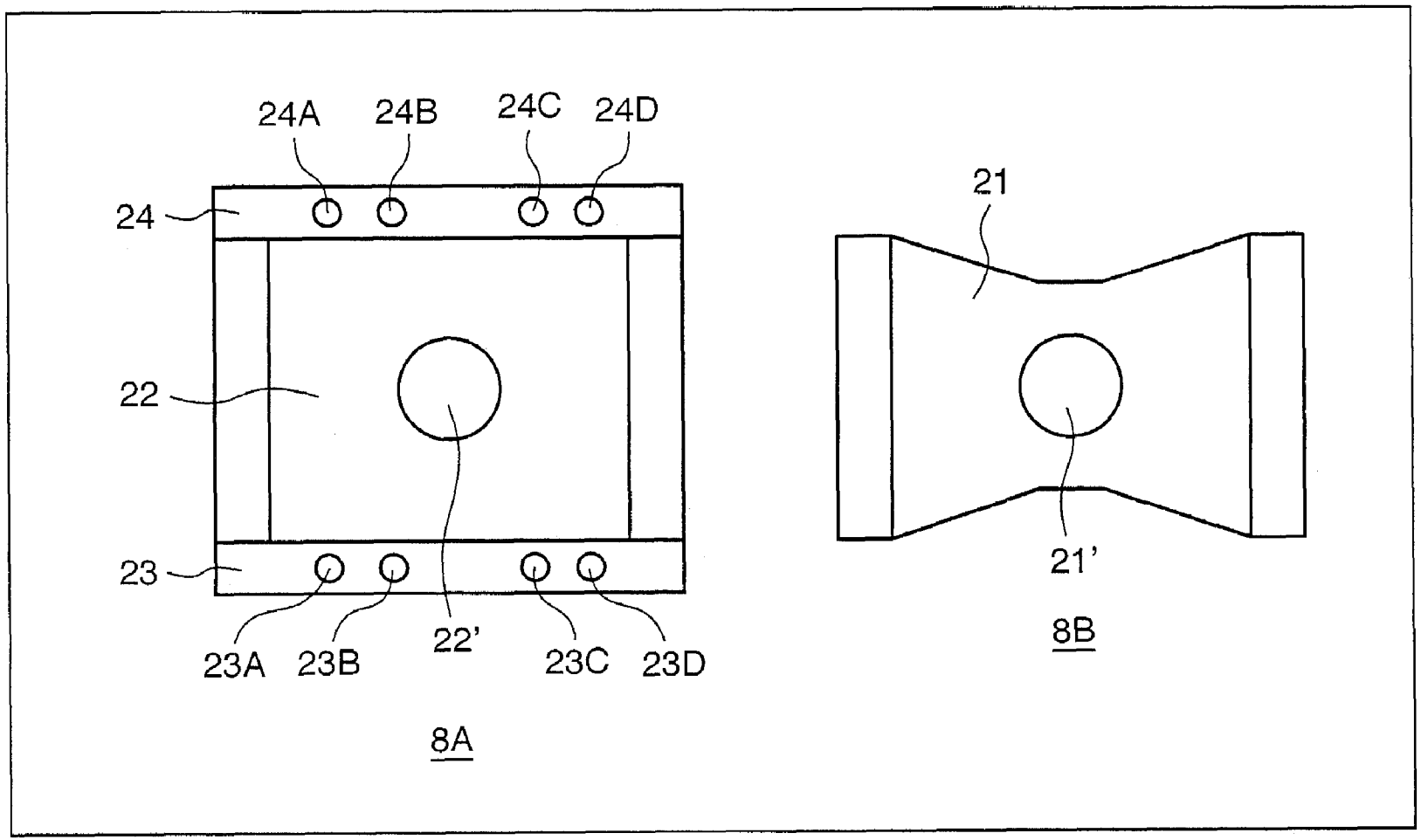
FIG. 8 includes developed views of a lower core portion and upper core portion employed in the transformer device according to the third embodiment.

FIG. 6 is a perspective view of a low-profile transformer device 50 according to the third embodiment of the present invention which employs the two-layer composite coil device 20 shown in the second embodiment in FIG. 5. 7A in FIG. 7 is a plan view, and 7B in FIG. 7 is a sectional view taken along the line X-X of the low-profile transformer device 50 of 7A. FIG. 8 shows the structure of the magnetic core of the transformer device 50 from which the composite coil device 20 has been removed.

This low-profile transformer device 50 has, as the basic arrangement, an upper core portion 21 made of a magnetic material shown in 8A in FIG. 8 and a lower core portion 22 similarly made of a magnetic material shown in 8B in FIG. 8. A cylindrical core portion 21' is formed at the center of the inner surface of the upper core portion 21. A cylindrical core portion 22' is formed at the center of the inner surface of the lower core portion 22. When assembling the low-profile transformer device 50, the cylindrical core portion 21' and cylindrical core portion 22' are touched as shown in 7B in FIG. 7. Thus, the cylindrical core portion 21' and cylindrical core portion 22' extend through a central hole 9 of the composite coil device 20.

The low-profile transformer device 50 has terminal boards 23 and 24 which are made of an insulator and formed on the two side surfaces of the low-profile transformer device 50. The terminal board 23 has metal coil-terminals 23A to 23D, and the terminal board 24 has similarly metal coil-terminals 24A to 24D. A lead wire 7 of the primary coil in the first winding portion and a lead wire 8 of the primary coil in the central portion in a coil device 1 are respectively connected and fixed with solder to the coil-terminals 23A and 23B of the terminal board 23. A lead wire 7' of the primary coil in the first winding portion and a lead wire 8' of the primary coil in the central portion in a coil device 1' are respectively connected and fixed with solder to the coil-terminals 23C and 23D.

A lead wire 10 of the secondary coil in the first winding portion and a lead wire 11 of the secondary coil in the second winding portion are respectively connected and fixed with solder to the coil-terminals 24A and 24B of the terminal board 24. A lead wire 10' of the secondary coil in the first winding portion and a lead wire 11' of the secondary coil in the second winding portion are respectively connected and fixed with solder to the coil terminals 24C and 24D. Thus, the low-profile transformer device 50 is formed.

The third embodiment is exemplified by a low-profile transformer device used in an inverter or the like. The present invention is not limited to be utilized in a low-profile transformer device used in a DC-DC converter, an inverter for driving a discharge lamp or the like, but can be utilized in transformer devices for various applications.

The products of the invention (as a prior art) disclosed in patent reference 1 and the present invention were actually made and compared in their characteristics. The following compared results were obtained. In both the prior art and the present invention, a round copper wire having a diameter of 0.7 mm was used for winding a coil.

According to the prior art, primary wires were wound in $\alpha$ winding method as upper and lower coils each by 3T, and a secondary wire was wound as middle coil by 2T between the upper and lower coils made by primary wires. Accordingly, the entire winding ratio of the primary coil to the secondary coil was 6T:2T. As a result of measurement, the primary coil had an inductance of 100 μH and a leakage inductance of 0.4 μH.

According to the present invention, a primary coil and secondary coil were wound in bifilar form (bundle winding) by 2T, and only the primary coil was wound in the upper portion by 4T. Accordingly, the entire winding ratio of the primary coil to the secondary coil was 6T:2T. As a result of measurement, the primary coil had an inductance of 100 μH and a leakage inductance of 0.2 μH.

From the above measurement results, since the leakage inductance decreases according to the present invention, the coupling degree between the primary coil and secondary coil is higher than that of the prior art. In the prior art, the winding structure is 3-layer overlaying structure, whereas in the present invention, the winding structure is 2-layer overlaying structure. By practicing the present invention, the transformer device with a lower profile can be made.

Figure 10:
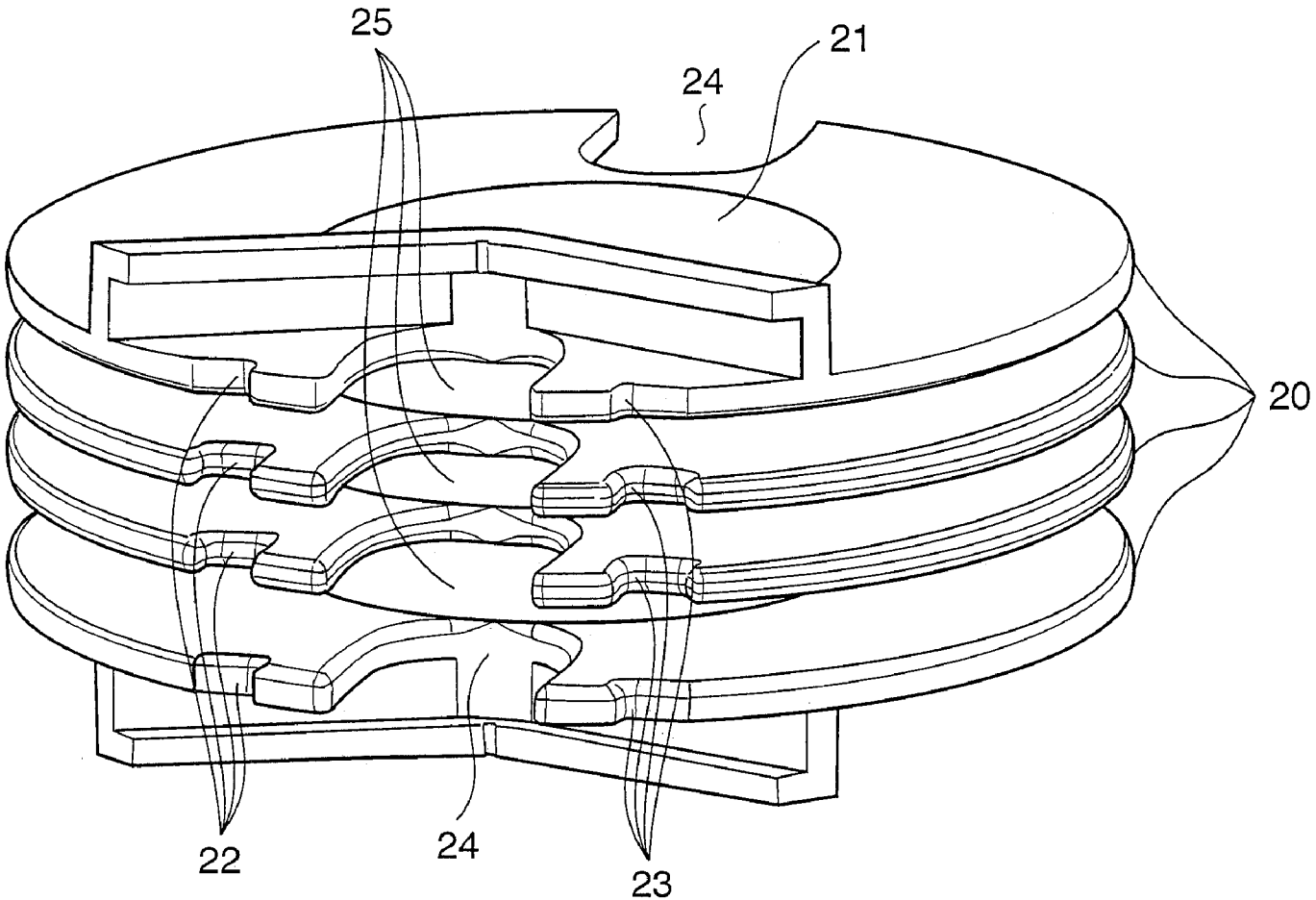
FIG. 10 is a perspective view of a coil winding frame that can be applied to an embodiment of the present invention.

In the embodiments described above, a coil winding frame was not used to wind wires. However, a coil winding frame may be usually used. For example, FIG. 10 is a perspective view of a coil winding frame that can be used in an embodiment of the present invention. Referring to FIG. 10, the coil winding frame has four flanges 20, and a space portion 21 at its center. Winding drums 25 are provided between the respective flanges 20. A pair of cavities 24 are formed at 180°-opposite positions of the flanges. Notches 22 and 23 are formed at both sides of one cavity 24.

In the coil winding frame having the above arrangement, for example, a first winding portion 2 and second winding portion 3 as shown in FIG. 1 are wound on the winding drums 25. A lead wire 8 of the primary coil in the central portion and a lead wire 7 of the primary coil in the first winding portion are fitted in the notches 22 and led to the lower side in FIG. 10. A lead wire 10 of the secondary coil in the first winding portion and a lead wire 11 of the secondary coil in the second winding portion are fitted in the notches 23 and led to the lower side in FIG. 10. A secondary coil connecting portion 4 is positioned in the cavities 24. The coil winding frame shown in FIG. 10 is an example, and the coil winding frame of the present invention is not limited to this structure. Similarly, each of the coil device, composite coil device, and transformer device of the respective embodiments can be made using a coil winding frame similar to that shown in FIG. 10.

The present invention is not limited to the above embodiments and various changes and modifications can be made within the spirit and scope of the present invention. Therefore, to apprise the public of the scope of the present invention, the following claims are made.

What is claimed is:

1. A coil device comprising:

a first winding portion in which a primary coil wire and a secondary coil wire are wound in bifilar form;

a second winding portion in which at least said secondary coil wire is wound so as to be arranged in a plane in parallel to a plane of said first winding portion; and a secondary coil connecting portion which connects an inner diameter portion of said secondary coil wire in said first winding portion to an inner diameter portion of said secondary coil wire in said second winding portion.

2. The coil device according to claim 1, wherein said primary coil wire and said secondary coil wire comprise a round wire.

3. The coil device according to claim 1, wherein said first winding portion and said second winding portion are made in α winding method starting from said secondary coil connecting portion.

4. The coil device according to claim 1, wherein said first winding portion and said second winding portion are formed on a coil winding frame having a plurality of flanges.

5. A composite coil device comprising a first coil device including a primary coil and a secondary coil, and a second coil device including a primary coil and a secondary coil, said first coil device and said second coil device being overlaid in a plane, at least said first coil device comprises:

a first winding portion in which a primary coil wire and a secondary coil wire are wound so as to be alternately arranged in a plane;

a second winding portion in which said secondary coil wire is wound so as to be arranged in a plane in parallel to the plane of said first winding portion; and a secondary coil connecting portion which connects an inner diameter portion of said secondary coil wire in said first winding portion to an inner diameter portion of said secondary coil wire in said second winding portion.

6. A transformer device comprising an upper core portion, a lower core portion, a first coil device including a primary coil and a secondary coil, and a second coil device including a first coil and a second coil, said first coil device and said second coil device being overlaid in a plane and arranged between said upper core portion and said lower core portion, at least said first coil device comprises:

a first winding portion in which said primary coil wire and said secondary coil wire are wound so as to be alternately arranged in a plane, a second winding portion in which said secondary coil wire is wound so as to be arranged in a plane in parallel to the plane of said first winding portion, and a secondary coil connecting portion which connects an inner diameter portion of said secondary coil wire in said first winding portion to an inner diameter portion of said secondary coil wire in said second winding portion.

7. The transformer device according to claim 6, wherein said primary coil wire and said secondary coil wire comprise a round wire.

8. The transformer device according to claim 6, whereon said primary coil and said secondary coil of each of said first coil device and said second coil device are wound in α winding method starting from said secondary coil connecting portion.

9. The transformer device according to claim 6, wherein said first coil device and said second coil device are formed on a coil winding frame having a plurality of flanges.

* * * * *